US012203268B2

(12) United States Patent
Low

(10) Patent No.: US 12,203,268 B2
(45) Date of Patent: Jan. 21, 2025

(54) REBAR WITH BRAIDED MULTI-AXIAL SLEEVE AND CONCRETE CORE FOR REINFORCING STRUCTURAL SUPPORT ELEMENTS

(71) Applicant: Raymond Alan Low, Monroeville, AL (US)

(72) Inventor: Raymond Alan Low, Monroeville, AL (US)

( * ) Notice: Subject to any disclaimer, the term of this patent is extended or adjusted under 35 U.S.C. 154(b) by 0 days.

(21) Appl. No.: 18/401,224

(22) Filed: Dec. 29, 2023

(65) Prior Publication Data

US 2024/0209630 A1 Jun. 27, 2024

Related U.S. Application Data

(63) Continuation-in-part of application No. 17/943,067, filed on Sep. 12, 2022, now Pat. No. 11,859,386, which is a continuation-in-part of application No. 17/836,226, filed on Jun. 9, 2022, now Pat. No. 11,619,047, which is a continuation-in-part of (Continued)

(51) Int. Cl.
*E04C 3/34* (2006.01)
*E04C 5/06* (2006.01)

(52) U.S. Cl.
CPC ..... *E04C 3/34* (2013.01); *E04C 5/0604* (2013.01)

(58) Field of Classification Search
CPC . E04C 3/34; E04C 5/0604; E04C 5/07; E04C 3/26; E04C 5/08; E04C 5/0618
See application file for complete search history.

(56) References Cited

U.S. PATENT DOCUMENTS 4,694,622 A * 9/1987 Richard ..... B28B 3/00 52/223.5
6,123,485 A * 9/2000 Mirmiran ..... E02D 31/02 405/232

(Continued)

FOREIGN PATENT DOCUMENTS

CA 2429927 A1 * 11/2004 ..... E04C 5/0609
CH 691608 A5 * 8/2001 ..... E04C 5/07
WO 2022056410 3/2022

*Primary Examiner* — Babajide A Demuren
(74) *Attorney, Agent, or Firm* — Jaquez Land Greenhaus & McFarland; James D. McFarland, Esq.

(57) ABSTRACT

BMASS rebar is disclosed herein that is useful for reinforcing structural support elements. BMASS (Braided Multi-Axial Sleeve System) rebar has a substantially solid configuration that includes a concrete core and a flexible, multi-axially braided reinforcement sleeve enclosing the concrete core, which provides sufficiently rigid, yet flexible rebar. The BMASS rebar does not contain polymer resins that would otherwise interfere with flexibility. The BMASS rebar can be utilized in structural support elements to support a wide variety of structures. BMASS rebar can constructed entirely of non-corrosive materials, therefore eliminating the possibility of corrosion. The BMASS rebar can be manufactured inexpensively and can be made in many different configurations. A BMASS rebar fabrication method can provide a quick, safe, low-cost, and simpler method to manufacture BMASS rebar on the jobsite. BMASS rebar offers many advantages over the steel rebar typically used for structural support of concrete structures.

13 Claims, 12 Drawing Sheets

Related U.S. Application Data application No. 16/996,905, filed on Aug. 19, 2020, now Pat. No. 11,408,176.

(60) Provisional application No. 62/888,854, filed on Aug. 19, 2019.

(56) References Cited

U.S. PATENT DOCUMENTS

| | | | | |
|---|---|---|---|---|
| 6,295,782 | B1 * | 10/2001 | Fyfe | E04C 3/34 52/359 |
| 2015/0190972 | A1 * | 7/2015 | Ehsani | B29C 73/34 156/475 |
| 2019/0177992 | A1 * | 6/2019 | Saadatmanesh | E04G 23/0225 |
| 2020/0284055 | A1 * | 9/2020 | Saadatmanesh | E04C 3/34 |

* cited by examiner

FIG. 1
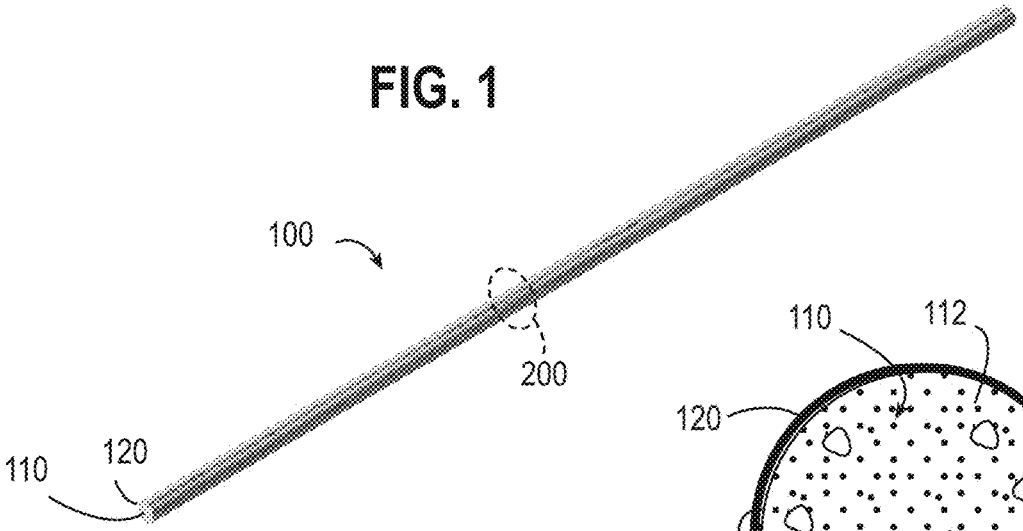
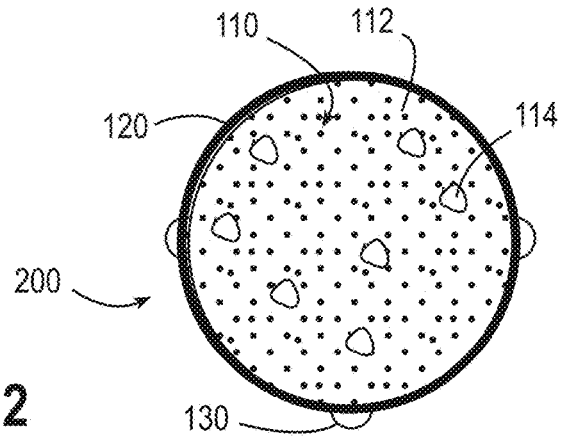
FIG. 2
FIG. 3
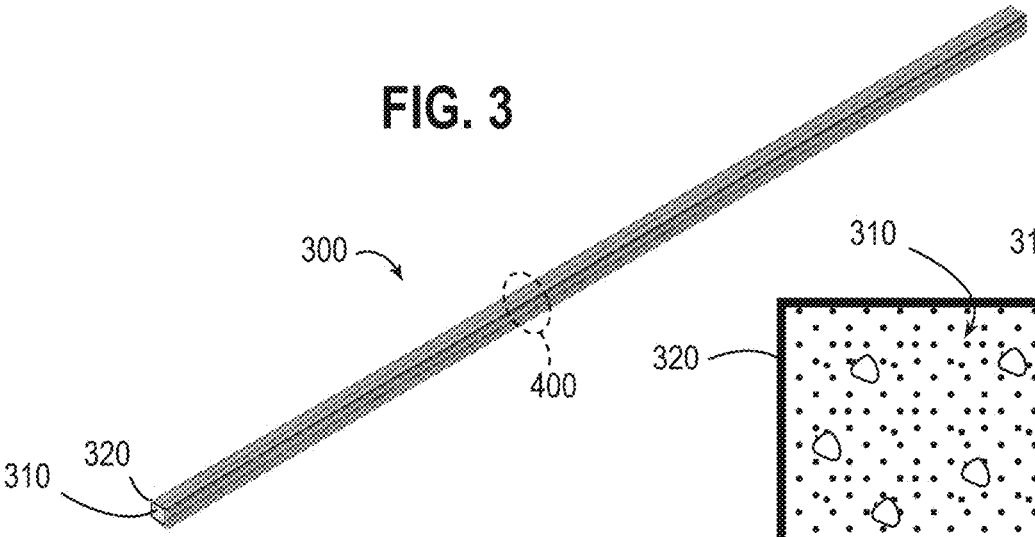
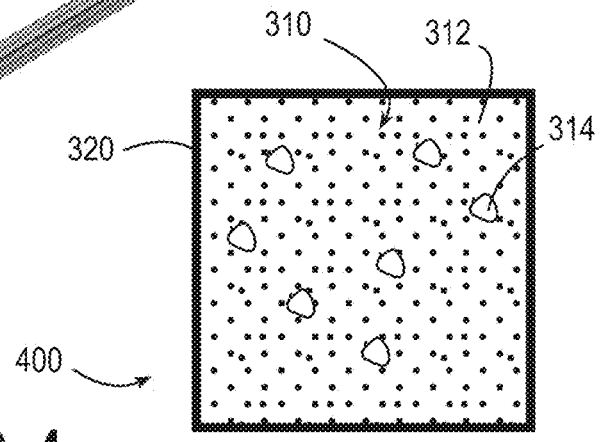
FIG. 4

REBAR WITH BRAIDED MULTI-AXIAL SLEEVE AND CONCRETE CORE FOR REINFORCING STRUCTURAL SUPPORT ELEMENTS

PRIORITY

Reference is made, and priority is hereby claimed to co-pending U.S. patent application Ser. No. 17/943,067 filed Sep. 12, 2022 entitled CABLE-SUPPORTED STRUCTURAL ASSEMBLY WITH FLEXIBLE REINFORCED CONCRETE STRUCTURAL ELEMENT, U.S. patent application Ser. No. 17/836,226, filed Jun. 9, 2022, now U.S. patent Ser. No. 11/619,047, entitled BRAIDED MULTI-AXIAL SLEEVE SYSTEM USED AS A STRUCTURAL REINFORCEMENT FOR CONCRETE COLUMNS AND METHOD FOR CONSTRUCTING CONCRETE COLUMNS, U.S. patent application Ser. No. 16/996,905, filed Aug. 19, 2020, now U.S. Pat. No. 11,408,176 entitled MULTI-AXIALLY BRAIDED REINFORCEMENT SLEEVE FOR CONCRETE COLUMNS AND METHOD FOR CONSTRUCTING CONCRETE COLUMNS, and U.S. Provisional Patent Application No. 62/888,854, filed Aug. 19, 2019, entitled MULTI-AXIALLY BRAIDED REINFORCEMENT SLEEVE FOR CONCRETE COLUMNS AND METHOD FOR CONSTRUCTING CONCRETE COLUMNS, all of which are incorporated herein by reference.

BACKGROUND

Technical Field

The invention relates to materials, components, and construction techniques for reinforcing structural support elements for building structures, such as buildings, bridges, parking garages and towers, using concrete aggregate.

2. Description of Related Art

All structures—from huts to skyscrapers and bridges—utilize structural elements to hold them up and keep them from collapsing. Two key structural elements are beams and columns, each playing an essential role in creating a load path to safely transfer the weight and forces acting on a structure to the foundation and into the ground. Beams are horizontal structural elements that withstand vertical loads, shear forces, and bending moments. Beams transfer loads imposed along their horizontal length to endpoints, such as columns, walls, and foundations. Columns are vertical support structures that hold up beams, roofs, and other parts of a building. Generally, a column is a strong, typically cylindrical structure that can extend from floor to ceiling inside a structure, or outside, from the ground up to the first, second or subsequent floors. Each column is designed with the compressive strength to hold the weight of what is above it, which can be very substantial. To construct vertical support structures, conventional construction techniques utilize concrete aggregate in combination with reinforcement materials such as steel rebar.

Concrete aggregate is commonly used in the construction industry. Concrete aggregate includes cement in various combinations with water, sand, gravel, and other materials that help add to its strength in the particular conditions in which the concrete will be employed. For ease of reference, the term "concrete" as used herein includes any of these combinations of cement and other materials that form a concrete aggregate.

Concrete has many advantages, including great compressive strength, good longevity with little maintenance, and it is relatively impervious to weather. However, there are some disadvantages to using concrete to construct columns. One disadvantage is concrete's low tensile strength. For example, if a column were to be made solely of concrete, it would crack and break relatively easily when subjected to tensile axial forces. To compensate for the low tensile strength, an internal structure is commonly utilized. For example, an internal structure may include one or more steel rebar rods situated vertically inside the column to improve the concrete column's tensile strength.

Under normal stress loads and environmental conditions, steel rebar rods as internal structures function adequately with concrete and provide good support for concrete columns. However, under the extreme conditions of fire, corrosion, or earthquakes, the steel reinforcement rods can undermine structural integrity, and destroy the very members they were designed to save. For example, corroding rebar steel, alone, costs every country 3 to 4% of its GDP in maintenance, repair, or replacement. Likewise, when steel rebar is directly exposed to fire, the steel rebar rapidly rises in temperature and can cause loss of the concrete cover due to spalling, which will significantly reduce the load-carrying capacity of the concrete member. When concrete columns are laterally loaded, as in an earthquake, the vertical steel rebar is placed in the precarious position of alternating between being placed under compression, then under tension, and then back again. When under tension, the vertical steel rebar elongates axially, breaking its bond with the concrete and allowing the concrete to crack. As the column bends back on the return swing, the steel rebar is now under compression, with all of the column's gravitational load placed on it. The vertical steel rebar now expands, cracking the concrete even more, spalling the concrete cover, eventually buckling, and forcefully ejecting the concrete core from its reinforcement cage, causing the column to fail, which in turn can bring down an entire building, or at least a portion of it.

Steel rebar has a number of other disadvantages that drive up construction costs. Manufacturing steel rebar requires specialized manufacturing facilities, high heat and expensive processes. Logistical planning is needed to deliver the appropriate amounts and lengths of steel rebar to the jobsite. Planning errors can cause construction delays, which can be costly. Transporting the steel rebar to the construction site can be expensive: steel is heavy and requires appropriate lifting equipment. Once the steel rebar arrives at the jobsite, it must be cut to the appropriate length, which drives up costs. Constructing a concrete structure supported by rebar requires constructing a concrete cover on the support structure to protect the steel rebar from corrosion to some extent, which also drives up costs.

It would be an advantage to provide rebar made of non-corrosive materials. It has been suggested to manufacture rebar with epoxy resin and carbon, glass or basalt fibers. However, manufacturing rebar with resins like epoxy can be very expensive, leading to higher production costs. Furthermore, the mechanical properties of rebar made with epoxy resin are not well-suited to building construction; e.g., rebar made with epoxy resin can lose strength at temperatures as low as 160 degrees Fahrenheit and lose all their tensile strength in a building fire.

It would be an advantage to provide an improved system and method for reinforcing structural support elements for buildings and other structures with non-corrosive building materials. It would also be an advantage to provide rebar at a lower cost, with better resistance against extreme events such fire, and earthquake damage. It would also be an advantage if the construction of the rebar, and support elements such as columns and beams could be produced easier, quicker, and safer.

SUMMARY

BMASS rebar is disclosed herein that is useful for reinforcing structural support elements such as columns, beams, foundations or slabs, and more generally to reinforce concrete or masonry support structures in buildings and other structures. BMASS (Braided Multi-Axial Sleeve System) rebar has a substantially solid configuration that includes a concrete core and a flexible, multi-axially braided reinforcement sleeve enclosing the concrete core, which provides sufficiently rigid, yet flexible rebar. The BMASS rebar does not contain polymer resins that would otherwise interfere with flexibility.

The BMASS rebar can be utilized in structural support elements to support a wide variety of structures such as buildings, bridges, and piers. Examples of structural support elements utilizing BMASS rebar are described. One or more BMASS rebars can be embedded in a concrete structure to support and reinforce the structure and thereby provide strong support.

A multi-sleeve embodiment is disclosed in which a BMASS rebar comprises a substantially solid concrete core consisting essentially of concrete with an outer multi-axially braided reinforcement sleeve embedded in the concrete on the perimeter of the core, and an inner reinforcement sleeve embedded in the concrete, situated concentrically within the outer reinforcement sleeve. The outer and inner reinforcement sleeves have a weave that is substantially flexible, and the BMASS rebar does not contain polymer resins that would otherwise interfere with flexibility.

The BMASS rebar can constructed entirely of non-corrosive materials and therefore eliminating the possibility of corrosion that might otherwise undermine the structural integrity of the structure.

The BMASS rebar can be manufactured inexpensively, thus reducing construction costs. Furthermore, the BMASS rebar can be made in many different configurations, which can be designed and/or selected to meet the requirements of a large variety of construction jobs.

A BMASS rebar fabrication method is described that can provide a quick, safe, low-cost, and simpler method to manufacture BMASS rebar on the jobsite, which provides significant advantages in cost, convenience, and avoidance of construction delays.

BMASS rebar offers many advantages over the steel rebar typically used for structural support of concrete structures, and therefore BMASS rebar described herein can replace steel rebar for many uses. Elimination of steel rebar is advantageous for a number of reasons: the properties of steel itself can contribute to the destruction of the structural element during extreme events such as fire, corrosion, or an earthquake. In contrast, the BMASS rebar flexes during these extreme events, allowing the structural element to flex while retaining most of its strength during and after extreme events. The BMASS rebar does not contain polymer resins that would otherwise interfere with sleeve flexibility or could degrade at even moderately high temperatures.

BRIEF DESCRIPTION OF THE DRAWINGS

For a more complete understanding of this invention, reference is now made to the following detailed description of the embodiments as illustrated in the accompanying drawing, wherein:

FIG. 1 is a perspective view of one embodiment of BMASS rebar.

FIG. 2 is a cross-sectional view of the embodiment of the BMASS rebar shown in FIG. 1.

FIG. 3 is a perspective view of an alternative embodiment of BMASS rebar that has an elongated rectangular configuration, illustrating that alternative embodiments of BMASS rebar can be non-cylindrical.

FIG. 4 is a cross-sectional view of the BMASS rebar of FIG. 3, showing that the cross-section is approximately square.

FIG. 9A shows the preferred circular cross-section, FIG. 9B shows a rectangular cross-section, FIG. 9C shows a flat rectangular ribbon cross-section, and FIG. 9D shows a thin rectangular band cross-section.

FIG. 10-A shows the beginning flow of cement paste out through the gaps in the sleeve, FIG. 10-B shows the sleeve strands covered by concrete paste after flowing into the gaps, and FIG. 10-C shows the textured concrete layer formed after the cement paste dries.

FIG. 8 is a side view of a section of the triaxially braided reinforcement sleeve, illustrating a triaxial weave.

DETAILED DESCRIPTION

(1) Terminology

Figure 5:
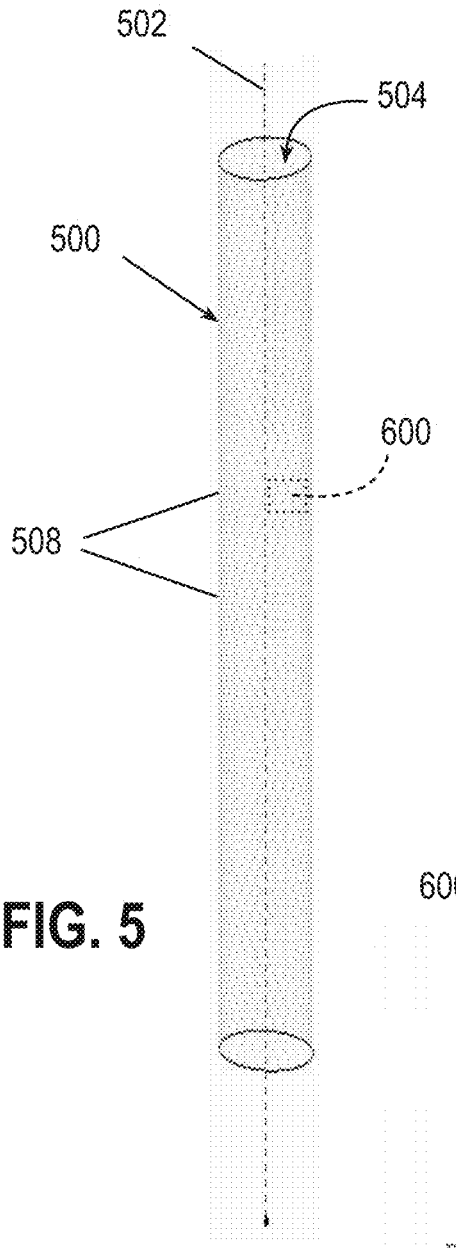
FIG. 5 is a perspective view of one embodiment of a multi-axially braided reinforcement sleeve that can be used to fabricate BMASS rebar.

As used herein, the term "concrete", or "concrete aggregate" includes cement in various combinations with water, sand, gravel, rocks, and other materials that help to add to its strength in the particular conditions in which the concrete will be employed. For ease of reference, the term "concrete" as used herein includes any of these combinations of cement and other materials.

For purposes herein, "concrete" can be defined as including a cement paste, a coarse aggregate, and other materials such as sand. The term "coarse aggregate" includes larger solids, like rock and gravel. The term "cement paste" includes water mixed with cement. When fresh, cement paste typically flows in a semi-liquid manner.

Rebar: Reinforcement Bar. Rebar is an elongated bar (typically a cylindrical rod) used that is used to reinforce a concrete or masonry structure as a tension device in reinforced concrete and reinforced masonry structures to strengthen and aid the concrete under tension. Concrete is strong under compression but has low tensile strength. Rebar significantly increases the tensile strength of the structure.

BMASS: Braided Multi-Axial Sleeve System

BMASS rebar element: A BMASS structure that is configured for use as rebar.

(2) Overview

A reinforced concrete BMASS rebar is disclosed that has an elongated (typically approximately cylindrical) shape having a first end and a second end, including a substantially solid concrete core consisting essentially of concrete and at least one reinforcement sleeve. The reinforcement sleeve has a substantially flexible, multi-axially braided weave, which provides flexible, yet strong, reinforcement for the BMASS rebar. The multi-axially weaved structure is particularly useful because it defines a type of selective locking mechanism: the weave pattern is close (tight) enough that it contains larger components of the concrete aggregate within the sleeve, yet the weaved pattern and material can allow cement paste to flow into and around the fibers of the sleeve. The flow of cement paste is sufficient to bond the sleeve to the concrete core, while holding the coarse concrete aggregate inside the sleeve.

Furthermore, the flow of cement paste through the gaps expels unwanted air and fills the spaces within the sleeve, so that the sleeve can become almost uniformly filled with concrete. A more uniform fill provides a stronger structure, substantially free of air pockets that might otherwise undermine the BMASS rebar's strength.

Various embodiments of BMASS rebar-reinforced support structures are disclosed herein. Although some of the support structures may be described as a column or a beam; similar principles can be applied to create other support structures such as posts and pilings. Structural implementations using BMASS rebar are disclosed in more detail in this application, and additional advantages are disclosed.

(3) Advantages of BMASS Rebar

BMASS rebar described herein offers many advantages over the steel rebar typically used for structural support of concrete structures, and therefore the BMASS rebar structure described herein can replace steel rebar in many support structures.

As mentioned in the Background section, steel rebar, which is widely used, has a number of disadvantages that drive up construction costs and limit its functionality when installed. Steel rebar requires specialized manufacturing facilities, high heat and expensive processes. In comparison, manufacturing the BMASS rebar described herein is a much less costly process, and can be done using an extrusion system, for example.

Advantageously, BMASS rebar can manufactured at or near the jobsite, which saves transportation costs and greatly simplifies planning logistics that could otherwise cause construction delays. Furthermore, BMASS rebar can be manufactured to any length specified by the contractor, and to any diameter required by the structural design.

As an additional advantage, BMASS rebar can be implemented in the support structure similarly to how steel rebar is used, so no additional training is required of the workers. Furthermore, due to the absence of steel rebar, no concrete cover would be required on the support structure, therefore no pedestals would be needed in slabs nor concrete covers in beams or columns.

As mentioned in the Background section, installed steel rebar easily corrodes, causing the spalling of concrete and thereby weakening the structure instead of strengthening it. Installed steel rebar readily conducts heat, and in so doing bypasses the concrete cover causing the spalling of concrete during a fire, thereby weakening the structure instead of strengthening it. Advantageously, BMASS rebar does not corrode, therefore the protective concrete cover (e.g., 1-½ inch) is not required on the structural support member in which it is used. Not needing the protective cover, for a given size, more concrete is available for strengthening purposes and therefore the concrete can be utilized more efficiently. Alternatively, the structural support can be made smaller (without the concrete cover that would otherwise be needed to protect steel reinforcement), thereby providing the same strength in a smaller package.

Also, BMASS rebar is made of the same or similar material as the concrete in which it is embedded, has about the same thermal conductivity as that of concrete, which lessens the possibility of any concrete spalling during a fire.

(4) BMASS Rebar Structure

FIG. 1 is a perspective view of one embodiment of BMASS rebar 100, and FIG. 2 is a cross-sectional view 200 of this embodiment of the BMASS rebar 100. The BMASS rebar 100 includes a concrete core 110 and at least one multi-axially braided reinforcement sleeve 120 surrounding the concrete core 110. The concrete core 110 includes an aggregate that includes cement 112, gravel 114, and other materials that help add strength in the particular conditions in which the concrete will be employed.

FIG. 2 is a cross-sectional view 200 of the BMASS rebar 100, showing an expanded view of a circular cross-section of the concrete core 110 and the reinforcement sleeve 120. The multi-axially braided reinforcement sleeve 120 will described in detail, for example with reference to FIG. 5 et seq. The outer surface of the BMASS rebar 100 can include textured features 130 adjacent to the reinforcement sleeve 120, such as ribs, lugs, or indentations spaced along the length of the BMASS. Alternatively, an abrasive material, such as sand, can be sprayed on the outer surface of the BMASS rebar while curing, so that the sand becomes embedded in the outer surface. The textured features 130 can prevent slippage and provide structural advantages such as greater pull-out resistance.

The BMASS rebar 100 can be manufactured in any suitable length; for example, it may be manufactured in standard lengths (e.g. 10, 15, 20 feet) and then cut to the desired length for a particular application on the jobsite, or pieced together if a longer length is needed. Alternatively, it can be manufactured on the jobsite to the specific desired length, which would not require either cutting or piecing together rebar.

In the embodiment of FIGS. 1 and 2, the BMASS rebar 100 has an elongated cylindrical rod configuration, which may for example have a cross-sectional dimension in ranges of 1 to 4 inches. The cylindrical configuration of the BMASS rebar is typical and preferred. However, in other embodiments, other cross-sectional configurations can be implemented, such as square, rectangular, oval, or whatever configuration is suited for the desired end use. Advantageously, BMASS rebar can be cost-effectively formed in a variety of different cross-sections and lengths, and the dimensions and shape can vary between embodiments.

FIG. 3 is a perspective view of an alternative embodiment of BMASS rebar 300 with an elongated rectangular configuration, illustrating a non-cylindrical embodiment of BMASS rebar. FIG. 4 is a cross-sectional view 400 of the BMASS rebar 300 showing that the cross-section 400 is approximately square. As in FIG. 1, the BMASS rebar 300 shown in FIG. 3 includes a concrete core 310 and at least one multi-axially braided reinforcement sleeve 320 surrounding the concrete core 310. Lengthwise, the BMASS rebar 300 may be directly made in any lengths, and if needed can be easily cut to a desired length on the jobsite. FIG. 4 is a cross-sectional view 400 of the BMASS rebar 300 showing an expanded view of a cross-section of the concrete core 310 and the reinforcement sleeve 320. In FIG. 4, the concrete core 310 includes an aggregate that includes cement 312, gravel 314, and other materials that help add to its strength. As in FIG. 2, the outer surface of the BMASS rebar 300 can be textured; e.g. with ribs or other protruding features, which can provide advantages such as greater pull-out resistance.

As will be described, BMASS rebar 100 can be integrated into various structures, in a variety of different configurations, to provide strength and resiliency against damage to the structure it is supporting. Depending upon the application, multiple BMASS elements may integrated into a structure; for example, a concrete column may be reinforced by three or more BMASS elements.

(5) Multi-Axial Braided Reinforcement Sleeve

Following is a detailed description of embodiments of reinforcement sleeves that can be used to fabricate BMASS rebar.

Figure 6:
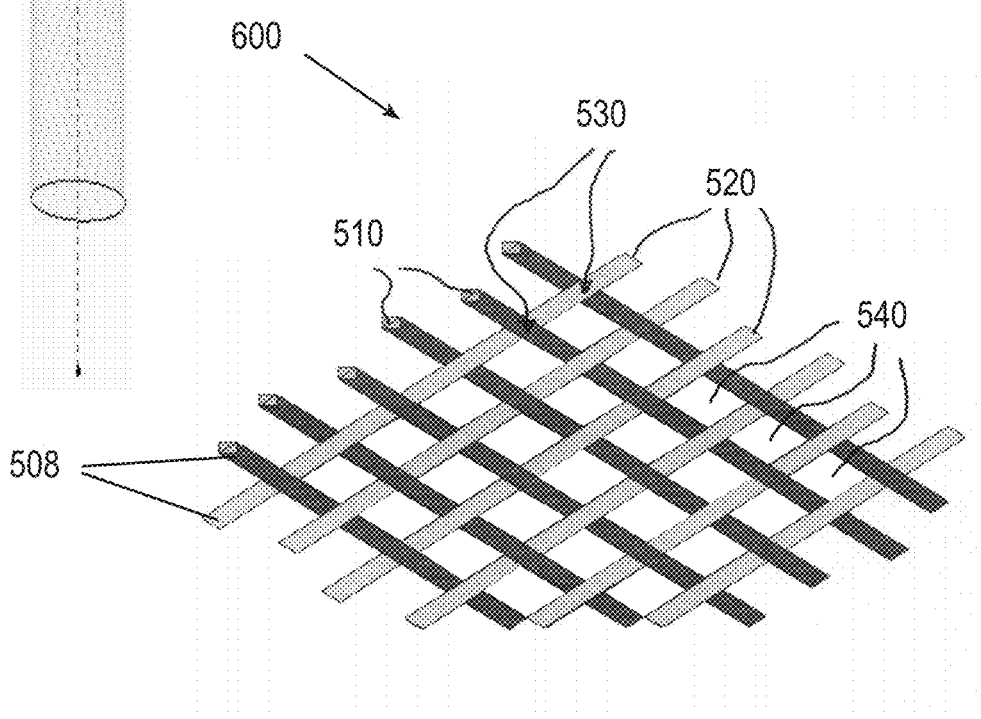
FIG. 6 is a perspective closeup view of a cut-out portion of one embodiment of the biaxially braided reinforcement sleeve.

FIG. 5 is a perspective view of one embodiment of a multi-axially braided reinforcement sleeve 500 that can be used to fabricate BMASS rebar, and FIG. 6 is a perspective closeup view of a cut-out portion 600 of one embodiment of the biaxially braided reinforcement sleeve 500. As shown in FIGS. 5 and 6, the multi-axially braided sleeve 500 includes a plurality of strands 508 including at least a first plurality 510 of strands and a second plurality 520 of strands that are axially braided around a central axis 502 to form a tubular braided structure that defines the sleeve 500 and a defines a central opening 504 axially through the tubular structure. Particularly, the first plurality of strands 510 are axially braided following a first rotation and the second plurality of strands 520 are axially braided following a second rotation counter-rotating to the first rotation. Thus, the first plurality of strands cross the second plurality of strands at a plurality of crossings 530, and the crossed pattern of the first and second plurality defines a plurality of gaps 540.

(6) BMASS Rebar Fabrication Overview

BMASS rebar can be fabricated by filling a reinforcement sleeve (such as shown in FIG. 5) with concrete, using any appropriate technique. In a manufacturing plant, the BMASS rebar 100 may be formed using pultrusion processes in which the sleeve is pultruded with concrete, through dies.

A texture may be formed on the outer circumference of the BMASS rebar during or after the pultrusion process, for example a textured pattern may be introduced during pultrusion, or an abrasive element (e.g. sand) may be sprayed on the BMASS rebar at some convenient point in the process. After the concrete has cured, the BMASS rebar can then be cut to length and transported to the construction location. Pultrusion is a continuous process of manufacture with an approximate constant cross-section by pulling the material, as opposed to extrusion which pushes the material.

Instead of fabrication in a manufacturing facility, BMASS rebar can be formed at or near a job site, which advantageously can save costs and time. In one example, portable pultrusion machines can be transported to at or near the jobsite to make the BMASS rebar there using the materials—concrete and the reinforcement sleeves—to fabricate the BMASS rebar to the appropriate configuration and appropriate length, which can greatly save construction costs and time.

Figure 23:
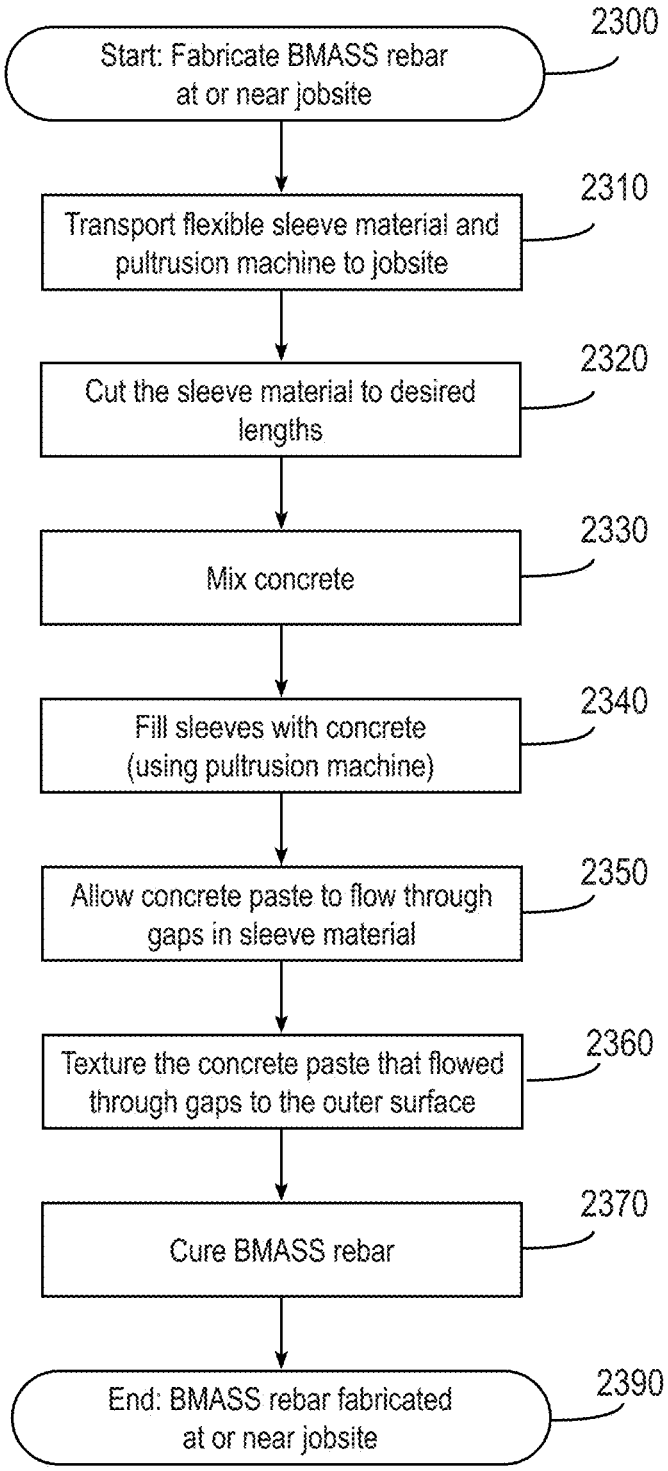
FIG. 23 is a flow chart that shows steps for fabricating BMASS rebar at a jobsite.

FIG. 23 is a flow chart that shows steps for fabricating BMASS rebar at or near a construction jobsite (STEP 2300). The sleeve material and a portable pultrusion machine are transported to (or near) the jobsite (STEP 2310). Advantageously, the reinforcement sleeve material can be easily transported to the jobsite; e.g., on a spool. At the jobsite the reinforcement sleeve can cut to any length (STEP 2320). Then the concrete is mixed (STEP 2330) and the sleeves are filled with concrete (STEP 2340). The concrete paste in the sleeve is allowed to flow through to the outer surface (STEP 2360), and then the outer surface can be textured (STEP 2360). The BMASS rebar is then cured (STEP 2370), and after curing the fabricated BMASS rebar is at the jobsite (STEP 2390) and ready for construction use.

(7) Braid Pattern: Weave

In some embodiments, such as the embodiment illustrated in FIG. 5 and FIG. 6, the braided reinforcement sleeve 500 has a biaxial weave pattern (the braid follows two counter-rotating axes) that defines the plurality of gaps 540 between the strands 508, and a plurality of strand crossings 530 where the strands cross. The gaps 540 may or may not allow some cement paste to flow through to the outside while holding the concrete aggregate inside the sleeve.

The particular weave pattern depends upon several factors such as design requirements, the properties of the concrete mixture, and the outside temperature. Different design requirements, and different types of concrete may require a different weave pattern, angle of weave, and type of reinforcement bands/ribbons. In different embodiments the type of concrete can vary, the compression stress of concrete can vary anywhere from less than 3,000 psi to over 10,000 psi, and the water/cement ratio can vary depending on weather conditions, the size of the pour, and the type of cement that is used. All these factors can be considered when selecting the appropriate sleeve for a particular rebar configuration.

(8) Triaxial Sleeve Embodiment

In other embodiments, such as will be described with reference to FIGS. 7 and 8, the weave pattern can be triaxial, in which the first and second plurality of strands cross as in the biaxial configuration, and a third plurality of strands are oriented substantially parallel with the axis of the column.

Figure 7:
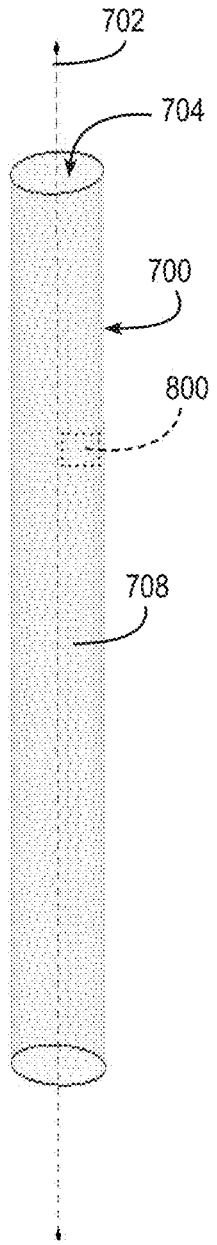
FIG. 7 is a perspective view of a triaxially-braided tubular reinforcement sleeve.

FIG. 7 is a perspective view of a triaxially-braided tubular reinforcement sleeve 700. As shown in FIG. 7, the tubular structure of the sleeve 700 defines a central axis 702 and a central opening 704, and the sleeve 700 includes a plurality of strands 708 weaved into a triaxial configuration around the central axis 702.

Figure 8:
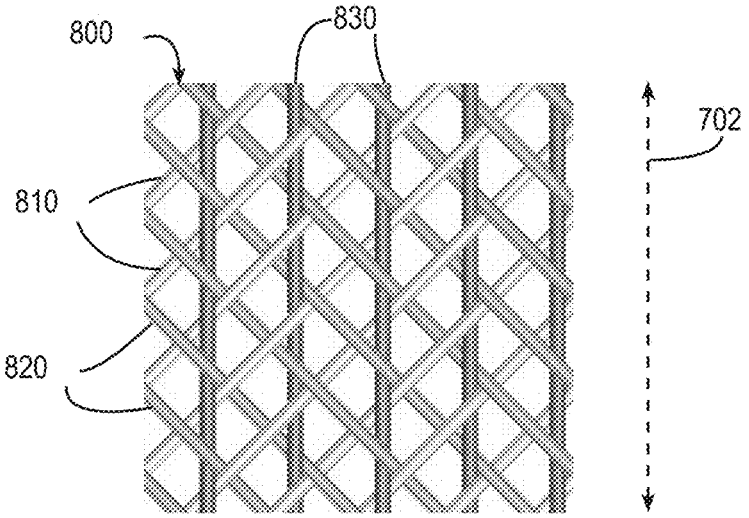
FIG. 8 is a side view of a cut-out section of the triaxially braided reinforcement sleeve of FIG. 7, illustrating the triaxial weave.

FIG. 8 is a side view of a cut-out section 800 of the triaxially braided reinforcement sleeve 700, illustrating the triaxial weave. As can be seen from this section 800, the plurality of strands include a first plurality of strands 810 crossed by a second plurality of strands 820, (similar to the biaxial weave) and in addition, the strands include a third plurality of strands 830 aligned substantially parallel to the central axis 702.

(9) Strand Material and Configurations

The material used in the strands can be any material such as metal, plastic, nylon, ceramics, basalt, aramid, carbon fiber, glass fiber, or any natural or synthetic material of suitable strength and durability that has the appropriate characteristics for the desired end application. Carbon, glass and basalt fibers have high melting points and would be especially beneficial where the potential for fire is anticipated.

Figure 9A:
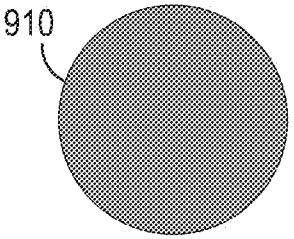
FIGS. 9A, 9B, 9C, and 9D are cross-sectional views of several different strand configurations.
Figure 9B:
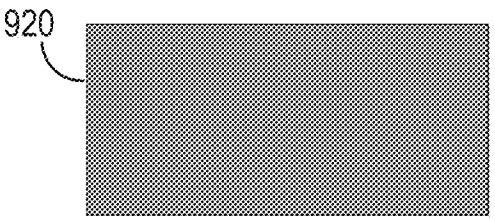
Figure 9C:
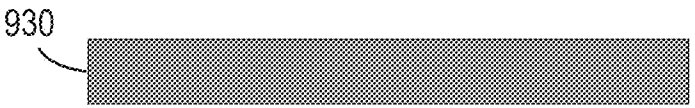
Figure 9D:
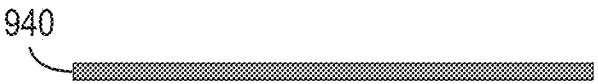

FIGS. 9A, 9B, 9C, and 9D show several different cross-sectional configurations for each single strand 508. Particularly, FIGS. 9A-D illustrate that the individual strands can have different forms and configurations, which can be selected to be suitable for the desired use. FIG. 9A shows a circular cross-section 910 (like a wire). The circular cross-section of FIG. 9A is preferred: more than likely the strands in the sleeve would be made of fiber, and therefore the strands would likely be circular. However, alternative cross-sections are possible: FIG. 9B shows a rectangular cross-section 920, FIG. 9C shows a flat rectangular ribbon cross-section 930, and FIG. 9D shows a thin rectangular band cross-section 940.

To choose the appropriate configuration for a particular construction job, one consideration is the strength and flexibility of the sleeve. Generally, a sleeve is selected to have a weave pattern, a strand configuration, and be made of a material that provides appropriate strength for the end use.

Although typically the materials and strand configurations will be consistent throughout the sleeve, in some embodiments some strands may comprise different materials and/or different configurations. For example, in the same sleeve, some strands may be nylon and others may be aramid, some strands may have a wire configuration and others may have a band configuration. The materials and configuration of the strands are chosen based on their properties to create the desired strength, flexibility, and weave pattern of the end product sleeve.

Many different types of strands can be used in the multi-axially braided reinforcement sleeve. Examples of strands include the following:

1) Filaments: strands can be comprised of thousands of filaments which are only about 5 to 10 microns thick, 3 k, 6 k, 12 k and 15 k, where k means thousands of filaments, can be found in each strand;
2) Materials: the material of the strands could be nylon, basalt, aramid, glass fiber, carbon fiber, or any synthetic or natural material of suitable strength and durability that can be woven into reinforcement sleeves.

Generally, the material and configuration of the strands are chosen to be relatively inelastic compared to the sleeve. For example, individual strands made of metal may not bend or stretch easily (i.e., they may be relatively inelastic). However, the overall braided sleeve will be substantially flexible due to its braided pattern, even if the individual strands are inelastic.

(10) Fabricating the Sleeve (Multi-Axially Braided Reinforcement Sleeve)

Fabricating the multi-axially braided reinforcement sleeve can be accomplished using any suitable method. Many braiding methods are known in the art, and the particular method chosen for forming the braided tubular structure will depend upon the requirements of any particular implementation. A few examples of methods and apparatus that can braid strands to create a tubular configuration are shown in US Patent Publication US20150299916, U.S. Pat. Nos. 7,311,031, 5,257,571, and 5,099,744.

As described above, the configuration of the strands 508, given the material, must be thick enough or of such density to substantially contain the concrete in the weaved pattern. The strands may be relatively inelastic for strength, and the braid pattern provides flexibility to the reinforcement sleeve.

In one embodiment, the braided sleeve has a biaxial weave pattern in which the first set of strands are wrapped around the central axis in a first rotation, and the second set of strands are wrapped around the central axis in a second, opposite rotation. In other embodiments, the braided sleeve may have a triaxial weave pattern, or a combination of an inner sleeve (comprised of a biaxial weave nearly lateral to the length of the column) and an outer sleeve (comprised of a triaxial weave pattern along the length of the column) working together, or other suitable weave patterns.

Many different materials and braid configurations can be implemented. Typically, the braided structure will be formed with a uniform braid pattern throughout its length. Still, many variations are possible with a uniform braid pattern, for example, the weaved pattern could include a finer mesh that would hold in place a stronger but looser weave of a different material. For example, the weaved pattern could include a finer nylon mesh that holds heavier aramid belts that are weaved into sleeves.

In some embodiments, it may be useful to vary the braid pattern in certain areas, so that the braid is nonuniform along its length. For example, one embodiment may create additional strength in certain portions of the sleeve by a tighter weave, or in other embodiments, more flexibility in the braid can be provided by using a looser weave.

The flexibility of the reinforcement sleeve would be adversely affected by the use of resins/polymers on the sleeve as the resins would harden and impair flexibility. The use of resins/polymers on the sleeve should be avoided because of their low melting point, toxin fumes when burnt, and incompatibility with concrete.

(11) Gaps

Figure 10A:
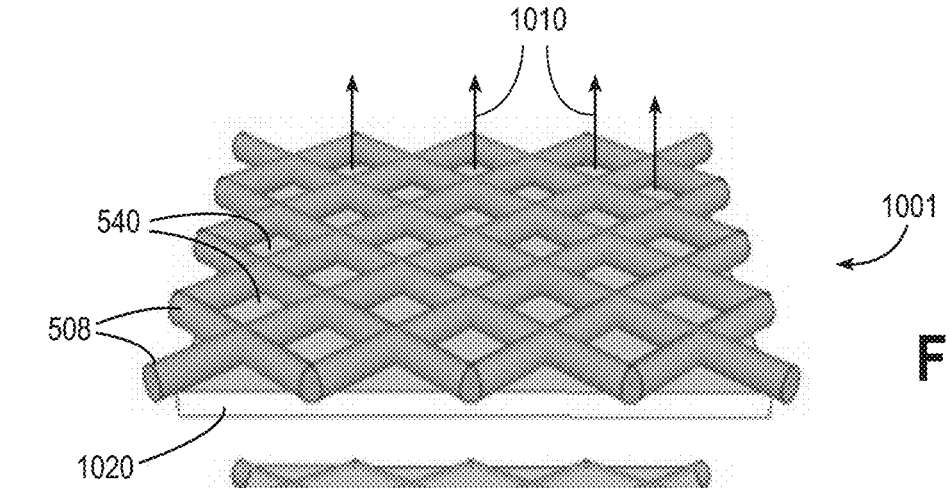
FIGS. 10-A, 10-B, and 10-C are close-up perspective views of a section of the outside of the BMASS rebar during fabrication, illustrating the flow of concrete through a section of the multi-axially braided reinforcement sleeve.
Figure 10B:
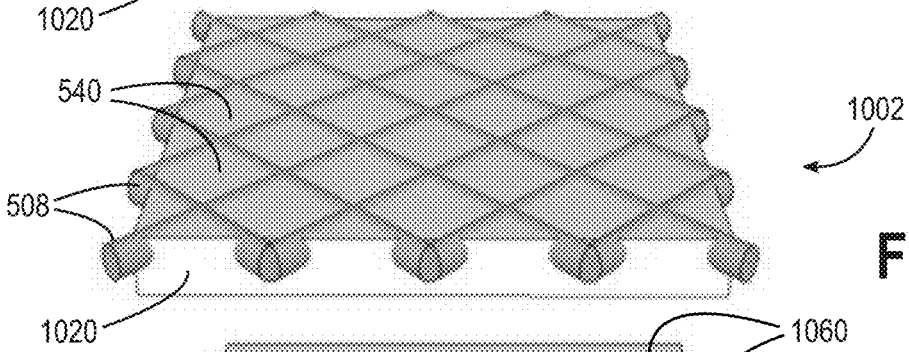
Figure 10C:
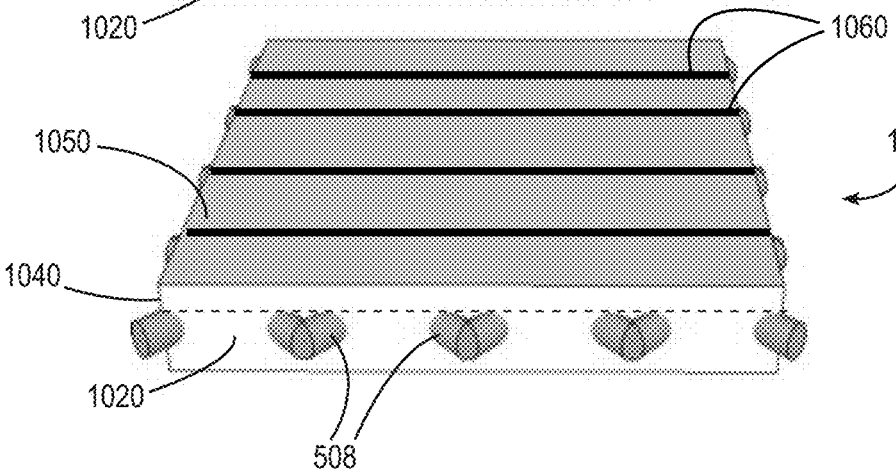

FIGS. 10A, 10B, and 10C are close-up perspective cut-out views of sections of the outside of the column, illustrating the flow of concrete through a section of the multi-axially braided reinforcement sleeve 500 during fabrication of BMASS rebar. In a multi-sleeve embodiment, a similar flow goes through an inner sleeve which will be described later with reference to FIG. 11 et seq.

The gaps 540 may or may not allow some cement paste to flow through to the outside while holding the concrete inside the sleeve. Advantageously, the flow of some cement paste (and maybe some sand or smaller particles) through the gaps expels unwanted air and fills the spaces within the sleeve, so that the sleeve column becomes approximately uniformly filled with concrete. A more uniform fill provides a stronger column structure substantially free of air pockets that might otherwise undermine the column's strength. The multi-axially weaved structure is particularly useful because it defines a type of selective locking mechanism.

FIG. 10A is a section 1001 that illustrates a beginning flow 1010 of cement paste 1020 out through the gaps 540 between the strands 508 in the reinforcement sleeve 500 (FIG. 5). FIG. 10B is a section 1002 after the concrete paste 1020 has flowed into the gaps 540, and substantially covers the strands 508. At this stage, the strands 508 have become substantially embedded within the concrete paste 1020. In some embodiments, the cement paste 1020 can be allowed to dry at this stage.

In other embodiments, as shown in FIG. 10C, the concrete paste 1020 can flow out farther from the gaps 540, to create an additional covering for the reinforcement sleeve, which optionally can be textured with an appropriate texture configuration 1060. FIG. 10C shows section 1003 of a concrete outer layer 1040 that is formed after the cement paste 1020 has flowed through the gaps and has become dried outside the strands 508 of the sleeve. As discussed above with reference to FIG. 5, the reinforcement sleeve defines gaps 540 that may or may not be large enough to allow a flow of the semi-liquid cement paste and small particles such as sand, but small enough to prevent the outward flow of coarse aggregate (e.g., gravel, rocks). As the semi-liquid cement paste 1020 flows through the gaps 540, it reaches the outer surface of the reinforcement sleeve, forms the outer layer 1040, and then dries into an outer surface 1050, which may be smooth.

(12) Multi-Sleeve Embodiment

In multi-sleeve embodiments of BMASS rebar, such as will be described with reference to FIGS. 11 and 12, the triaxial sleeve 700, or any reinforcement sleeve described herein, may be combined with an inner sleeve 1100 that has a plurality of substantially unidirectional strands, oriented transverse to the central axis of the sleeve.

Figure 11:
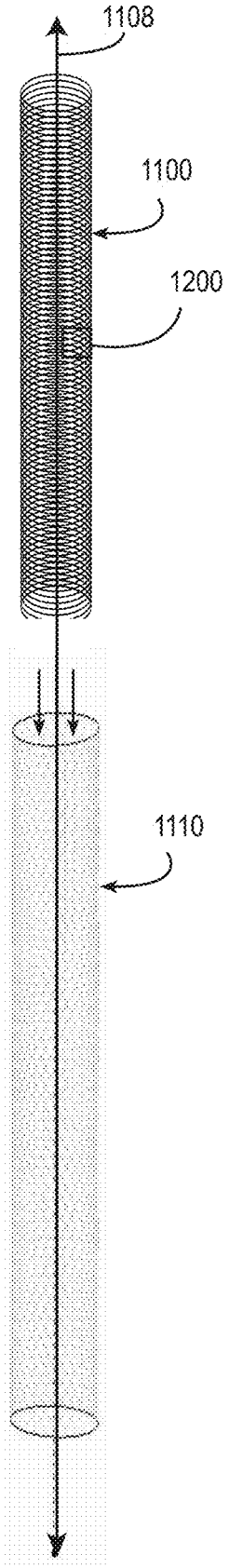
FIG. 11 is a perspective view of a sleeve arrangement that includes an inner reinforcement sleeve and an outer reinforcement sleeve.

FIG. 11 is a perspective view of a sleeve arrangement that includes an inner reinforcement sleeve 1100 and an outer reinforcement sleeve 1110. The inner sleeve 1100 has a size to fit concentrically within an outer sleeve 1110. The inner reinforcement sleeve 1100 has a plurality of strands that are oriented in a substantially lateral direction (i.e., the strands wrap laterally or transverse to a central axis 1108 defined by the inner and outer sleeves. The outer sleeve 1110 comprises a multi-axially braided sleeve such as the triaxially-braided sleeve 700 (FIG. 7) or the biaxially-braided sleeve 500 (FIG. 5). The outer and inner reinforcement sleeves have a weave that is substantially flexible and do not contain polymer resins that would otherwise interfere with sleeve flexibility.

The inner reinforcement sleeve 1100 may be manufactured in a tubular configuration. In alternative embodiments, the inner reinforcement sleeve 1100 can be formed by wrapping a sheet of unidirectional material so that the direction of the material's strength is substantially lateral to the central axis. The inner reinforcement sleeve 1100 concentrically fits within the outer reinforcement sleeve 1110. In some embodiments, the inner and outer reinforcement sleeves may be connected by any suitable means.

Figure 12:
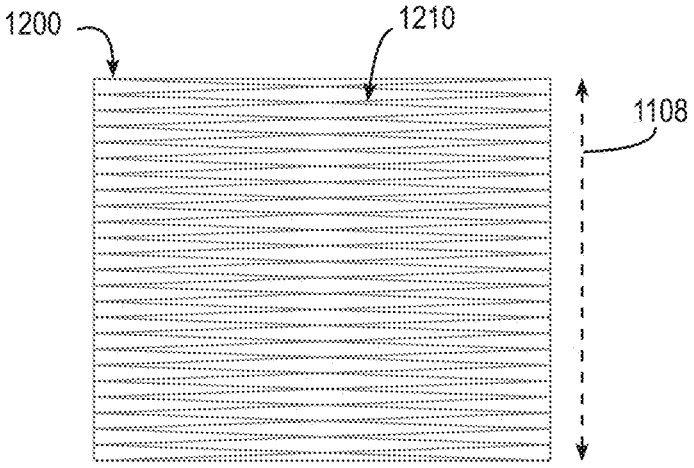
FIG. 12 is a side view of a cut-out section of the inner reinforcement sleeve, illustrating a weave in one embodiment that is substantially lateral to the central axis.

FIG. 12 is a side view of a cut-out section 1200 of the inner reinforcement sleeve 1100, illustrating a lateral weave 1210 in one embodiment that is substantially lateral to the central axis 1108. Generally, the weave may be provided in any suitable configuration such as a biaxial weave with very small-angle crossings, a spiral, or hoops with longitudinal connections, or any other weave that provides substantial strength in the transverse direction.

Figure 13:
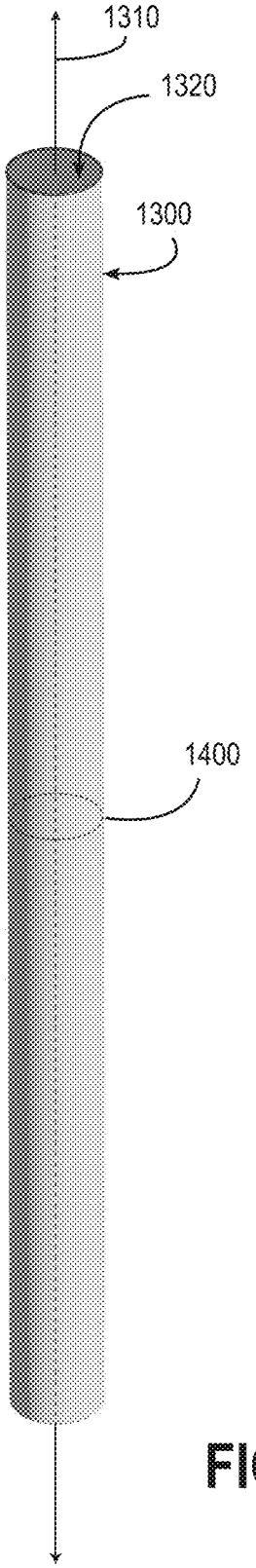
FIG. 13 is a perspective view of a multi-sleeve BMASS rebar that has a cylindrical shape that includes a central core, an inner reinforcement sleeve, and an outer reinforcement sleeve around its perimeter.
Figure 14:
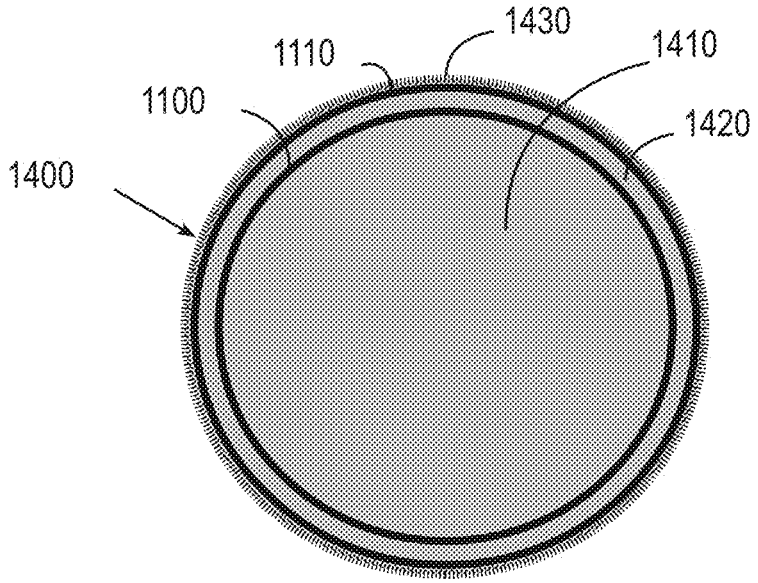
FIG. 14 is a cross-sectional view that shows the inner reinforcement sleeve and the outer reinforcement sleeve embedded in the BMASS rebar.

FIG. 13 is a perspective view, and FIG. 14 is a cross-sectional view, of a multi-sleeve BMASS rebar 1300 that has a cylindrical shape that defines a central axis 1310 and includes a central core 1320, the inner reinforcement sleeve 1100, and the outer reinforcement sleeve 1110 around its perimeter. FIG. 14 is a cross-sectional view that shows the inner reinforcement sleeve 1100 and the outer reinforcement sleeve 1110 embedded in the BMASS rebar. The central core is now filled with concrete, including coarse aggregate and cement paste, that provides a concrete core 1410 within the reinforcement sleeves consisting essentially of concrete. The outer reinforcement sleeve 1110 is now embedded in concrete on the outside perimeter of the concrete core 1410, and the inner reinforcement sleeve 1100 is situated concentrically within the outer sleeve 1110.

In the embodiment shown in FIGS. 14, the concrete has flowed through the inner reinforcement sleeve 1100 and into the outer reinforcement sleeve 1110, so that both the inner and outer reinforcement sleeves are embedded in the concrete. For purposes of illustration, the inner and outer reinforcement sleeves are shown separated by a middle concrete layer 1420. In some embodiments, the inner and outer reinforcement sleeves may be adjacent to each other and in those embodiments, the middle concrete layer 1420 may be small or non-existent.

FIG. 14 also shows a texture 1430 formed on the outer perimeter of the BMASS rebar 1400. This texture is generally a rough surface or deformations to the surface area that functions to maintain the position of the rebar when it is installed in a structural support element.

Figure 15:
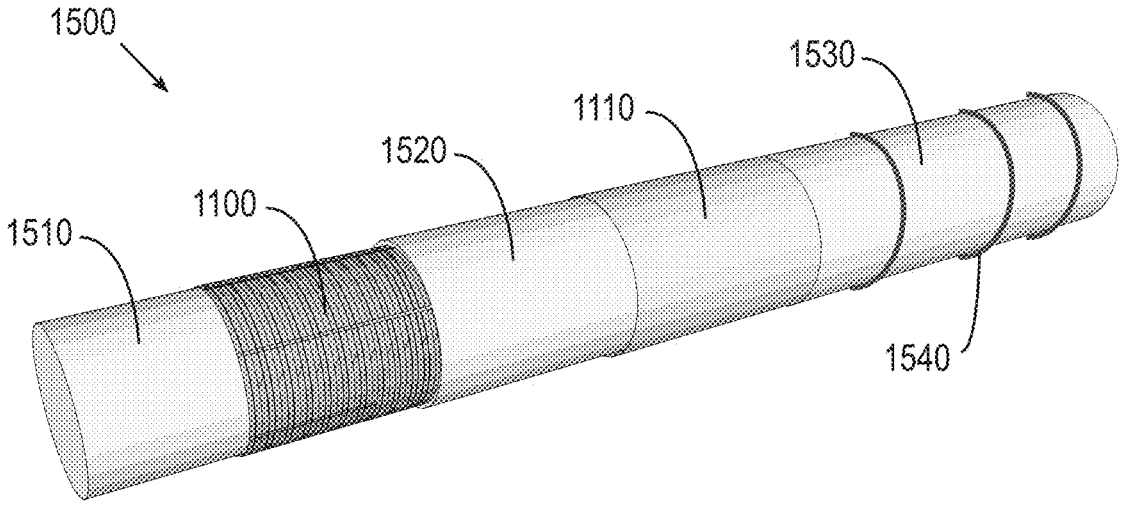
FIG. 15 is a perspective, cut-away view of a section of a multi-sleeve embodiment of a BMASS element with BMASS rebar inside for additional strength.

FIG. 15 is a perspective, cut-away view of a section 1500 of a multi-sleeve embodiment of a BMASS element with BMASS rebar inside for additional strength. The BMASS element includes the inner reinforcement sleeve 1100 and the outer reinforcement sleeve 1110 embedded in the BMASS rebar section 1500. The concrete core 1510 is formed within the reinforcement sleeves, consisting essentially of concrete. In the FIG. 15 embodiment, the concrete has flowed through the inner reinforcement sleeve 1100 and into the outer reinforcement sleeve 1110, so that both the inner and outer reinforcement sleeves are embedded in the concrete, creating a middle concrete layer 1520 between the reinforcement sleeves 1100, 1110. After the concrete paste has flowed out through the outer reinforcement sleeve 1110 and cured sufficiently, it can be textured to create an outer concrete layer 1530, which provides a texture that helps to maintain the BMASS rebar in position within the structural element in which it will be installed. The outer reinforcement sleeve 1110 is now embedded in concrete on the outside perimeter, and the inner reinforcement sleeve 1100 is situated concentrically within the outer sleeve 1110. FIG. 15 also shows a plurality of ridges 1540, that function as a texture to hold the rebar in position when installed.

(13) Structural Support Elements Using BMASS Rebar

BMASS rebar can be utilized to strengthen many different structural support elements such as columns, beams, and slabs. Depending upon the implementation, multiple BMASS elements may be integrated into a structural support element. In these support elements, BMASS rebar is typically internally situated longitudinally along the axis of the support element; e.g., BMASS rebar may be situated longitudinally in a column; however, the BMASS rebar may be situated in any orientation that provides the needed support.

It should be apparent that BMASS rebar can be integrated into various structural support elements, in a variety of different configurations, to provide strength, and resiliency against damage. Following are examples of structural support elements reinforced with BMASS rebar.

Figure 16:
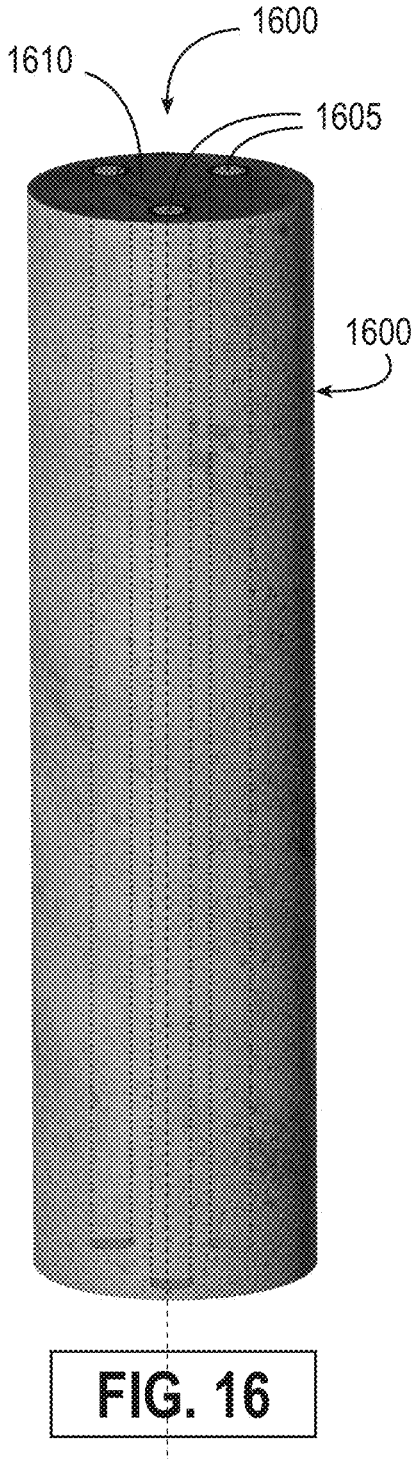
FIG. 16 is a perspective view of a structural support element that has a cylindrical concrete configuration.

FIG. 16 is a perspective view of a structural support element 1600 that has a cylindrical concrete configuration, which for purposes of description may be called a column, but could also be used as a post, or a piling for example. The column 1600 includes a plurality of BMASS rebar elements 1605 longitudinally situated within a concrete core 1610. This illustrated embodiment shows three BMASS rebar elements 1605, all of which support the column 1600. In other embodiments any number of BMASS rebar elements may be utilized, depending upon the design configuration.

In the embodiment illustrated in FIG. 16, the concrete column 1600 does not have additional reinforcement other than the BMASS rebar elements 1605. In other column embodiments, additional column reinforcement may be used, such as the multi-axially braided reinforcement sleeve described in the applications cross-referenced above, which are incorporated by reference herein.

Figure 17:
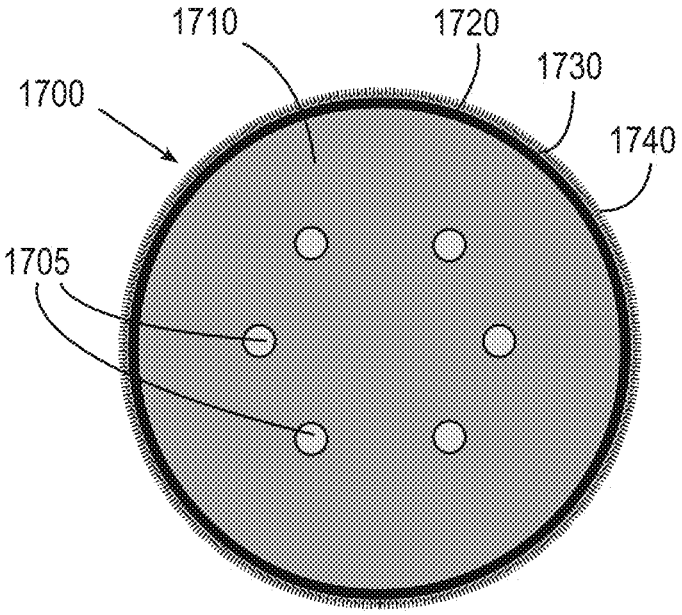
FIG. 17 is a cross-sectional view of an embodiment of a column that includes a column reinforcement sleeve in addition to BMASS rebar.

FIG. 17 is a cross-sectional view 1700 of an embodiment of a column that includes a column reinforcement sleeve 1720 in addition to BMASS rebar. The embodiment of FIG. 17 includes a plurality of BMASS rebar elements 1705 embedded in a central core 1710 that includes concrete, including coarse aggregate and cement paste. A multi-axially braided reinforcement sleeve 1720 is embedded in concrete around the outside perimeter of the concrete core 1710. Fabrication and description of the column with the reinforcement sleeve is described in more detail in the patent applications cited in the cross-reference section of this application. Advantageously, the multi-axially braided reinforcement sleeve 1720 contains the concrete within the core 1710 and supports the column transversely. Yet during extreme earthquake events, the reinforcement sleeve 1720 doesn't go under compression and therefore does not expand to cause any damage to the column. Instead, if the column drifts due to earthquake forces, the reinforcement sleeve 1720 may elongate and tighten around the column. The column embodiment illustrated in FIG. 17 also includes an outer layer 1730 of dried cement paste and small particles that enclose the reinforcement sleeve 1720 that provide a rough texture 1740.

Figure 18:
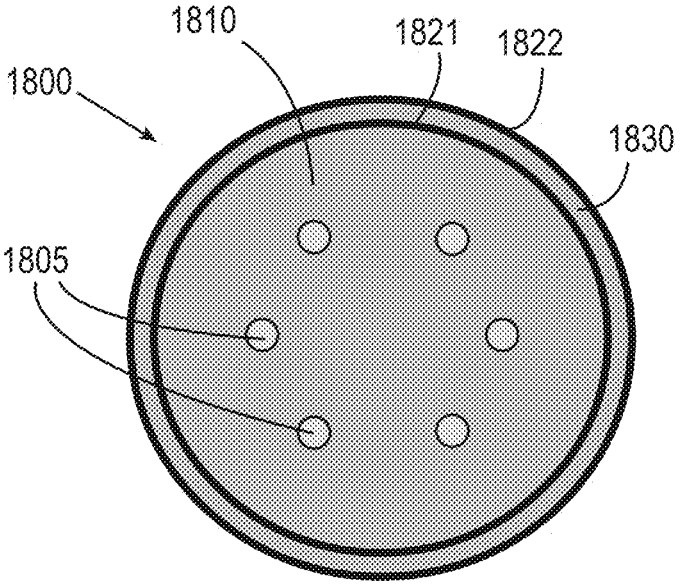
FIG. 18 is a cross-sectional view of an alternative embodiment of a BMASS-reinforced column.

FIG. 18 is a cross-sectional view 1800 of another embodiment of a BMASS-reinforced column. The embodiment of FIG. 18 shows a plurality of BMASS rebar elements 1805 embedded in a central core 1810 that includes concrete, including coarse aggregate and cement paste. To reinforce the column, two reinforcement sleeves are provided: an inner reinforcement sleeve 1821 is embedded in concrete around the outside perimeter of the concrete core 1810, and an outer reinforcement sleeve 1822 is provided around the outside perimeter of the inner reinforcement sleeve 1821. A concrete interlayer 1830 may be disposed between the inner and outer reinforcement sleeves.

As shown in FIG. 18, the inner and outer reinforcement sleeves 1821,1822 contain the concrete within the core 1810 and also support the column transversely. Advantageously, during extreme earthquake events, the reinforcement sleeves doesn't go under compression and therefore do not expand to cause any damage to the column. Instead, if the column drifts due to earthquake forces, the reinforcement sleeves may elongate and tighten around the column, providing better support.

Figure 19:
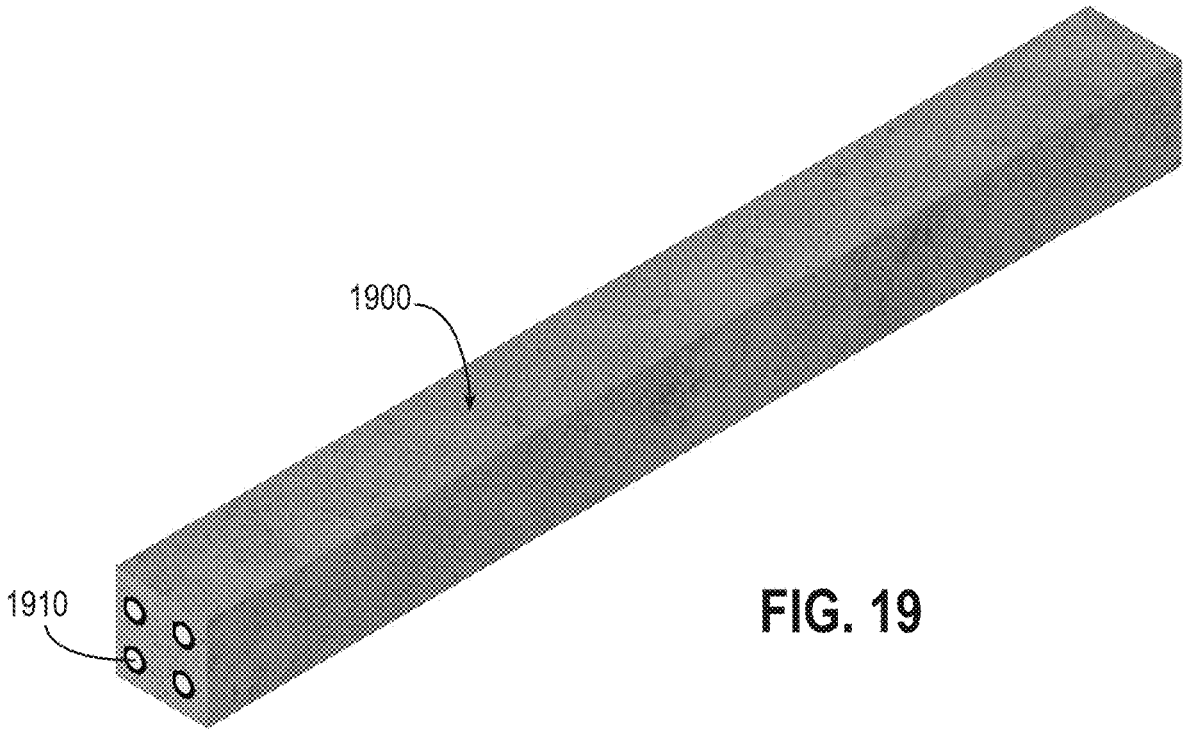
FIG. 19 is a perspective view of a rectangular structural support element that can be used as a beam in a structure and can have other uses such as a piling for a dock or retaining wall.

FIG. 19 is a perspective view of a rectangular structural support element 1900, which can be used as a beam in a structure and can have other uses such as a piling for a dock or retaining wall. The rectangular element 1900 includes BMASS rebar 1910 axially disposed in the concrete beam 1900 to provide structural strength between a first end 1920 and a second end 1930. This example uses four BMASS rebar components 1910 (such as the BMASS rebar 100) axially disposed in a rectangular concrete box structure; in other embodiments more or less BMASS rebar components may be used. In FIG. 19 the BMASS rebar itself is cylindrical, which is typical, and provides a very strong structural configuration and significant strength to the support element 1900.

(14) Structure Examples

As discussed above, BMASS rebar can be utilized to strengthen many different structural support elements, such as columns, beams, pilings, and posts. These structural support elements maybe be used to support many different structures. Following are examples of structures that can utilize support elements reinforced with BMASS rebar, it should be apparent that many different structures can use BMASS-reinforced rebar.

Figure 20:
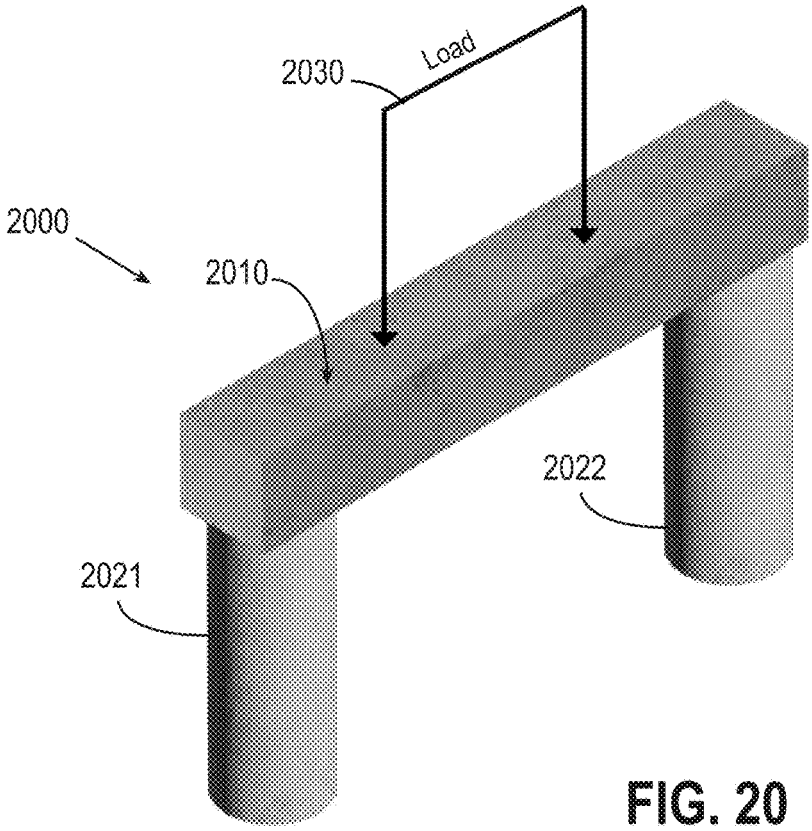
FIG. 20 is a perspective view of a simple structure 2000 that includes a BMASS rebar-reinforced beam supported on each end by a BMASS rebar-reinforced column.

FIG. 20 is a perspective view of a simple structure 2000 that includes a BMASS-reinforced beam 2010 (such as the rectangular support element 1900), supported on each end by a BMASS-reinforced column: particularly a first column 2021 and a second column 2022 (such as the column 1600)

support the opposite ends of the beam 2010. The beam 2010, and each of the columns 2021,2022 has a plurality of BMASS rebar rods inside, situated longitudinally within the respective support element. Preferably, the BMASS rebar rods are approximately parallel to each other.

This simple support structure 2000 may be a utilized to support a wide variety of structures, for example, either side of a bridge and columns in a structure. The columns 2021, 2022 may be formed with a notch or other cut-out shaped to receive the respective ends of the BMASS-reinforced beam 2010. A load 2030, which may, for example, be a bridge, road surface, or the floor of a building, exerts downward forces all along the adjacent surface of the BMASS element, as illustrated by arrows. Generally, the columns must be strong enough to hold against the forces exerted by the load on the structure 2000.

(15) Example of BMASS Beam Assembly Installed in Structure

Figure 21:
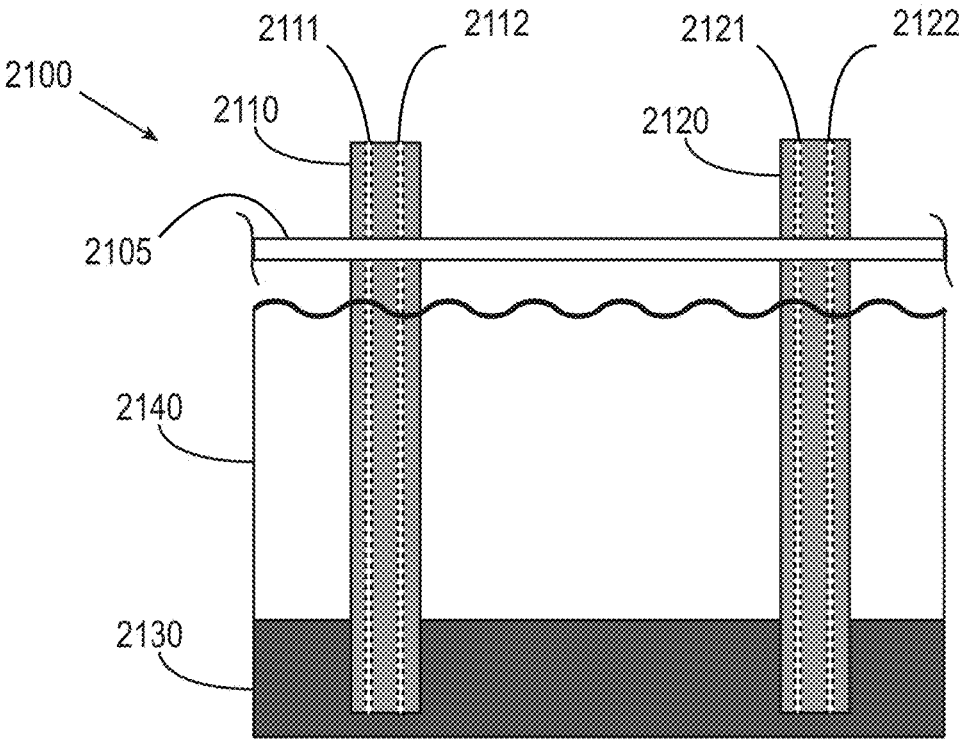
FIG. 21 is a cross-sectional view of example of a structure that may be a bridge or including a platform supported by BMASS rebar-reinforced pilings.

FIG. 21 is a side view of another example of a structure 2100, which may be a bridge or dock that includes a platform 2105 supported by BMASS-reinforced pilings, including a first piling 2110 and a second piling 2120. The first piling 2110 has at least two BMASS rebar rods 2111, 2112, and likewise, the second piling 2122 has at least two BMASS rebar rods 2121,2122 installed longitudinally in the pilings, and approximately parallel.

The pilings support a platform 2105, which, for example may be the walkway of a dock, or a road for autos. The pilings 2110, 2120 are set deeply into the sea floor 2130, under the water 2140 in order to stabilize the structure 2100.

Advantageously, the concrete and sleeve material used to manufacture the BMASS rebar 2112, 2122 could be customized to meet different conditions such as the environmental demands of the sea floor, or structural requirements. For example, in a water (or humid) environment, the BMASS rebar would not rust, unlike steel rebar.

(16) BMASS Posts

BMASS rebar could be utilized to reinforce BMASS posts, which could be manufactured in custom diameters, for example two, three or four inches. Customization could be done on the jobsite.

Figure 22:
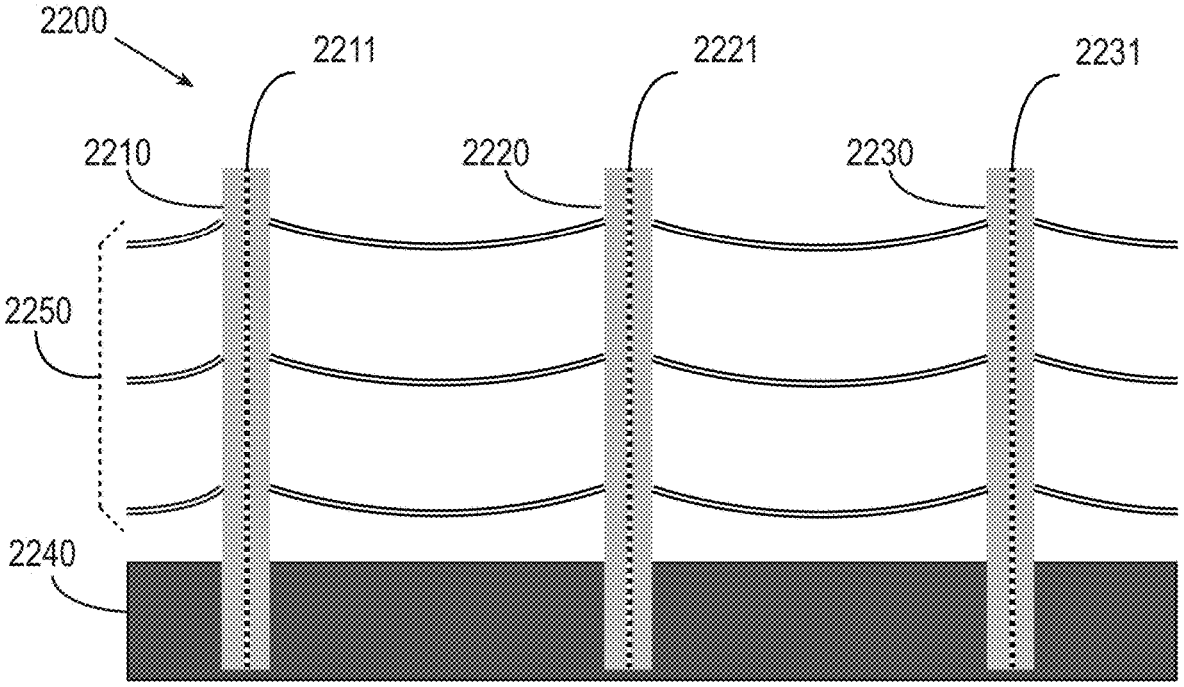
FIG. 22 is a cross-sectional view of a portion of a fence that includes a plurality of BMASS rebar-reinforced fence posts secured into the ground, and fence wire.

FIG. 22 is a side view of a portion of a fence 2200 that includes a plurality offence posts and fence wire. Particularly, FIG. 22 shows first, second, and third fence posts 2210,2220,2230, secured into the ground 2240. Fence wire 2250 is strung between the fence posts and secured to each fence post.

Each post is made of concrete or other suitable material and is reinforced with BMASS rebar. Particularly, the first post 2210 is reinforced by a first BMASS rebar 2011, the second post 2220 is reinforced with a second BMASS rebar 2221, and the third post 2230 is reinforced with a third BMASS rebar 2231.

Alternatively, larger diameter BMASS rebar itself could be used as micro/mini piles, small support columns or just simple fence posts. For example, 2-, 3-, or 4-inch BMASS rebar could be manufactured, cut into suitable lengths, and used as piles, support columns or fence posts.

Advantageously, the concrete and sleeve material used to manufacture the BMASS rebar and posts could be customized to meet different conditions such as the environmental demands of the soil, or structural requirements.

(17) General

Terms and phrases used in this document, and variations thereof, unless otherwise expressly stated, should be construed as open-ended as opposed to limiting. As examples of the foregoing: the term "including" should be read as meaning "including, without limitation" or the like; the term "example" is used to provide examples of instances of the item in a discussion, not an exhaustive or limiting list thereof, the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements, or components of the disclosed method and apparatus may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described with the aid of block diagrams, flow charts, and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. BMASS rebar for reinforcing structural support elements, comprising:

an elongated configuration that includes a substantially solid concrete core and a flexible, multi-axially braided reinforcement sleeve embedded in the concrete around the perimeter of the core;

wherein the substantially solid concrete core consists essentially of concrete formed of a dried cement mixed with a coarse aggregate;

wherein the multi-axially braided reinforcement sleeve has a weave that is substantially flexible; and wherein the flexible multi-axially braided sleeve includes a first plurality of strands and a second plurality of strands axially braided into a braided structure, the first plurality of strands axially braided following a first rotation and the second plurality of strands axially braided following a second rotation chosen so that the first plurality crosses the second plurality of strands and provides a weaved pattern that provides a flexible sleeve and defines a plurality of gaps, each of the plurality of gaps defining an opening having a size small enough to substantially contain the coarse aggregate and large enough to allow a minimal flow of cement paste.

2. The BMASS rebar of claim 1 wherein the BMASS rebar does not contain polymer resins.

3. The structural concrete column of claim 1 further comprising a textured concrete outer layer formed with cement paste that flowed through the gaps in the multi-axially braided sleeve.

4. The concrete column of claim 3 wherein the textured outer layer comprises a plurality of ridges.

5. The BMASS rebar of claim 1 wherein the first and second plurality of strands comprise a flexible material.

6. The BMASS rebar of claim 5 wherein the flexible material comprises at least one of steel, metal, plastic, nylon, basalt, aramid, ceramics, glass, and carbon fiber.

7. The BMASS rebar of claim 1 wherein the elongated configuration is substantially cylindrical.

8. The BMASS rebar of claim 1 wherein the weaved pattern is configured so that in response to an earthquake and other tensile stresses, the flexible multi-axial braid reinforcement sleeve tightens around the core, thereby strengthening the rebar structural support element.

9. The BMASS rebar of claim 1 further comprising an inner reinforcement sleeve embedded in the concrete situated concentrically within the reinforcement sleeve, so that both sleeves provide reinforcement for the BMASS rebar.

10. A BMASS-reinforced structural support element including:

a concrete structure that defines the support element; and a plurality of BMASS rebar rods situated longitudinally within the support element, each BMASS rebar rod having:

a long, approximately cylindrical shape that defines a first end and a second end;

a substantially solid concrete core consisting essentially of concrete;

a flexible, multi-axially braided reinforcement sleeve embedded in the concrete around the perimeter of the core; the sleeve having a weave that is substantially flexible;

wherein the flexible multi-axially braided sleeve in the plurality of BMASS rebar rods includes a first plurality of strands and a second plurality of strands axially braided into a braided structure, the first plurality of strands axially braided following a first rotation and the second plurality of strands axially braided following a second rotation chosen so that the first plurality crosses the second plurality of strands and provides a weaved pattern that provides a flexible sleeve and defines a plurality of gaps, each of the plurality of gaps defining an opening having a size small enough to substantially contain the coarse aggregate and large enough to allow a minimal flow of cement paste;

a textured outer surface.

11. The BMASS-reinforced structural support element of claim 10 wherein the structural support element is configured as at least one of a beam, a column, a post, a piling, a slab, and a foundation.

12. The BMASS-reinforced structural support element of claim 10 further comprising a plurality of structural support elements, configured to define a structure.

13. The BMASS-reinforced structural support element of claim 10 wherein the structural support element has a cross-section that is at least one of circular and rectangular.

* * * * *